US007231852B1

(12) United States Patent
Henin et al.

(10) Patent No.: US 7,231,852 B1
(45) Date of Patent: Jun. 19, 2007

(54) FAUCET NUT WRENCH KIT

(76) Inventors: Albert J. Henin, 241 Vanceville Dr., W. Tawakoni, TX (US) 75474; Valerie J. Williams, 241 Vanceville Dr., W. Tawakoni, TX (US) 75474

( * ) Notice: Subject to any disclaimer, the term of this patent is extended or adjusted under 35 U.S.C. 154(b) by 0 days.

(21) Appl. No.: 11/440,395

(22) Filed: May 25, 2006

(51) Int. Cl.
*B25B 13/56* (2006.01)
*B25B 13/48* (2006.01)

(52) U.S. Cl. ..... 81/124.2; 81/176.15

(58) Field of Classification Search ..... 81/121.1, 81/124.2, 124.4, 176.15, 176.2, 177.2, 177.5; 285/401, 402
See application file for complete search history.

(56) References Cited

U.S. PATENT DOCUMENTS 4,800,786 A * 1/1989 Arnold et al. ..... 81/121.1
4,882,958 A * 11/1989 McNeeley ..... 81/124.4
5,542,321 A * 8/1996 Fuca ..... 81/125.1
5,615,587 A 4/1997 Foerster, Jr.
5,697,268 A * 12/1997 Makovsky et al. ..... 81/125
5,809,851 A * 9/1998 Thompson ..... 81/124.2
5,996,447 A 12/1999 Bayouth
6,009,779 A * 1/2000 Mastroni ..... 81/438
6,171,033 B1 * 1/2001 Wrobel ..... 408/239 R
6,282,994 B1 * 9/2001 Wei ..... 81/121.1
6,374,708 B1 * 4/2002 Kunz ..... 81/124.2
6,698,317 B1 3/2004 Machovsky
6,701,807 B1 * 3/2004 Gammon ..... 81/119
7,096,765 B1 * 8/2006 Diggle et al. ..... 81/124.4
2004/0194585 A1 * 10/2004 Clark ..... 81/124.2
2004/0211299 A1 * 10/2004 Chen ..... 81/121.1
2006/0081094 A1 * 4/2006 Ludwig et al. ..... 81/124.2

* cited by examiner

*Primary Examiner*—David B. Thomas
(74) *Attorney, Agent, or Firm*—Crossley Patent Law; Mark A. Crossley

(57) ABSTRACT

A kit of four faucet nut wrenches, two of 1⅜ inch internal diameter, two of 1 inch internal diameter, longer wrenches 14–16 inches long, shorter wrenches 4 inches long. Drive sockets are provided for removable insertion into the drive end of each wrench. The smaller diameter wrenches are optionally held within the larger wrenches. Orifices in of the wrenches provide for the smaller diameter wrenches optional insertion into the larger diameter wrenches. Removable lock pins secure the wrenches together.

4 Claims, 6 Drawing Sheets

FAUCET NUT WRENCH KIT

BACKGROUND OF THE INVENTION

Faucets are secured to counters by faucet nuts. The faucet nuts are partially comprised of wings. Additionally, faucet supplies are secured to faucets by way of a smaller faucet nut with wings. Faucet nuts are threadably engaged on faucet nipples. The nipples are tubular, hollow, and externally threaded. Faucets are typically in hard to reach areas, such as under a sink counter. Reaching the nuts by hand is usually quite difficult. Tightening and loosening faucet nuts by hand, with most available nut wrenches, is not always possible. Further, most available faucet nut wrenches do not offer the reach possibilities needed to reach all faucet nuts. Hand cannot always adequately secure the fixture. Loosening a nut by hand is often impossible due to the nut being unreachable, over tightened, or frozen. Most existing tools require the use of a screwdriver or like device inserted perpendicularly into the faucet nut tool in order to gain the leverage needed to turn the tool. Space for such levers is seldom available. Space limitations also exist due to the length of most nut wrenches offered. Reaching and leveraging the nuts often calls for either a short or a long wrench. Accessibility to faucet nuts varies. What is needed is a kit which provides various sizes and lengths of wrenches for faucet nuts. The kit should further provide a hand-grip means for turning the wrenches, as well as further leverage for the wrenches. The kit should also contain wrenches whereby a square drive tool, such as a ratchet, can be used to rotate the wrench.

1. Field of the Invention

The faucet nut wrench kit relates to faucet nut wrenches and more particularly to a faucet nut wrench kit.

2. Description of the Prior Art

Prior related art is replete with devices for turning faucet mounting nuts. Each device offers some unique feature. None of the devices known comprises a kit which provides various lengths of faucet nut wrenches, and various sizes of wrenches for addressing different sizes of faucet nuts. Further, the devices do not offer the socket wrench drives of the present invention. U.S. Pat. No. 5,996,447 issued to Bayouth on Dec. 7, 1999 teaches a wrench for engaging a faucet mounting nut. The wrench includes an elongated tubular pipe which has slots at one end and holes in an opposite end for inserting a screwdriver or the like. The tool is limited to either hand rotation without any aids for such, or screwdriver driven rotation. The tool is not a part of a kit for various nut applications.

U.S. Pat. No. 6,698,317 issued to Machovsky on Mar. 2, 2004 teaches a multi-purpose plumbing tool which is comprised of two parts. Like U.S. Pat. No. 5,996,447, one tool part relies upon holes into which a screwdriver or the like can be inserted. U.S. Pat. No. 5,615,587 issued to Foerster, Jr. on Apr. 1, 1997 teaches a deep-socket driver with a plurality of slots which can engage the corners of a hexagonal nut, not a wing nut. The driver is further adapted for a hexagonal drive which can be engaged into a drill chuck. The driver is not adapted for a square drive, such as a ratchet.

While the above-described devices fulfill their respective and particular objects and requirements, they do not describe a faucet nut wrench kit that provides for the advantages of the present faucet nut wrench kit. In this respect, the faucet nut wrench kit substantially departs from the conventional concepts and designs of the prior art. Therefore, a need exists for an improved faucet nut wrench kit.

SUMMARY OF THE INVENTION

The general purpose of the faucet nut wrench kit, described subsequently in greater detail, is to provide a faucet nut wrench kit which has many novel features that result in an improved faucet nut wrench kit which is not anticipated, rendered obvious, suggested, or even implied by prior art, either alone or in combination thereof.

To attain this, the faucet nut wrench kit includes tubular faucet nut wrenches of varied lengths and internal diameters. The kit also includes drive sockets and lock pins for the wrenches. Each wrench is comprised of a drive end, an engagement end, and a length therebetween. The wrench choices include two wrenches which offer an internal diameter of about 1⅜ inch. This is a commonly needed size to address faucet nuts which hold faucet assemblies to counters. The longer of the two wrenches of 1⅜ I.D. (internal diameter) is 14 to 16 inches in length. The shorter wrench having an I.D. of about 1⅜ inch is about 4 inches long. The kit also includes two wrenches with an I.D. of about 1 inch. These wrenches are commonly used to engage smaller faucets nuts such as those which hold water supply lines to various faucets. The two smaller I.D. wrenches are offered in the same lengths as those two of larger I.D. wrenches. The kit is further comprised of at least two drive sockets which removably fit within the drive ends of the wrenches. Each drive socket features a female square drive whereby a ratchet or other square drive tool can be used to rotate the wrench. Each wrench also features a grip surface proximal to the end of the drive end. The outside diameter of the wrenches and the grip surface of each provides for a plumber to use only hand tightening of faucet nuts when desired. The grip surfaces also provide the plumber with the means for loosening those faucets nuts encountered which have not been over tightened or frozen in place. Further, the wrenches are used individually or combined to form various lengths. The smaller diameter wrenches fit within the larger diameter wrenches.

Yet another embodiment of the invention comprises the same two longer wrenches, of different diameters, with drive capability and faucet nut engagement capability on both ends. Each end, both engagement and drive, is comprised of grip surface proximal to the end of the wrench. Each longer wrench also comprises a pin orifice proximal to each end, both engagement and drive, of the wrench. One end of each of the longer wrenches varies from the opposite end in that the slots differ. One end of each of the longer wrenches contains three slots equidistantly spaced about the outer diameter of the wrench, rather than the four slots of the opposing end.

Various embodiments of the wrenches with varied arrangement and number of wing nut slots are provided, the plurality of wing nut slot arrangements thereby enabling the engagement of a varied number of wings on various sink nuts.

Assembly of the wrenches is accomplished via the pin orifices of the chosen wrenches positioned in alignment, then secured by a removable lock pin. Disassembly of the wrenches is via reversal of assembly. The kit is constructed of plastics, polymers, or metals, or a combination of these materials.

Thus has been broadly outlined the more important features of the improved faucet nut wrench kit so that the detailed description thereof that follows may be better understood and in order that the present contribution to the art may be better appreciated.

It is therefore an object of the faucet nut wrench kit to fit different sizes of faucet nuts.

It is also an object of the faucet nut wrench kit to provide varied lengths of wrenches needed for addressing faucets nuts.

It is a further object of the faucet nut wrench kit to provide wrenches which can be combined in length.

It is an added object of the faucet nut wrench kit to provide for hand tightening and loosening of faucet nuts with the wrenches.

And, it is an object of the faucet nut wrench kit to provide for the use of square drive tools to drive the wrenches.

A further object of the faucet nut wrench kit is to provide a kit which engages a plurality of wing nut wing arrangements.

These together with additional objects, features and advantages of the improved faucet nut wrench kit will be readily apparent to those of ordinary skill in the art upon reading the following detailed description of presently preferred, but nonetheless illustrative, embodiments of the improved faucet nut wrench kit when taken in conjunction with the accompanying drawings.

In this respect, before explaining the current embodiments of the improved faucet nut wrench kit in detail, it is to be understood that the faucet nut wrench kit is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved faucet nut wrench kit. It is therefore important that the claims be regarded as including such equivalent constructions insofar as they do not depart from the spirit and scope of the faucet nut wrench kit. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 7 thereof, the principles and concepts of the faucet nut wrench kit generally designated by the reference number 10 will be described.

Figure 1:
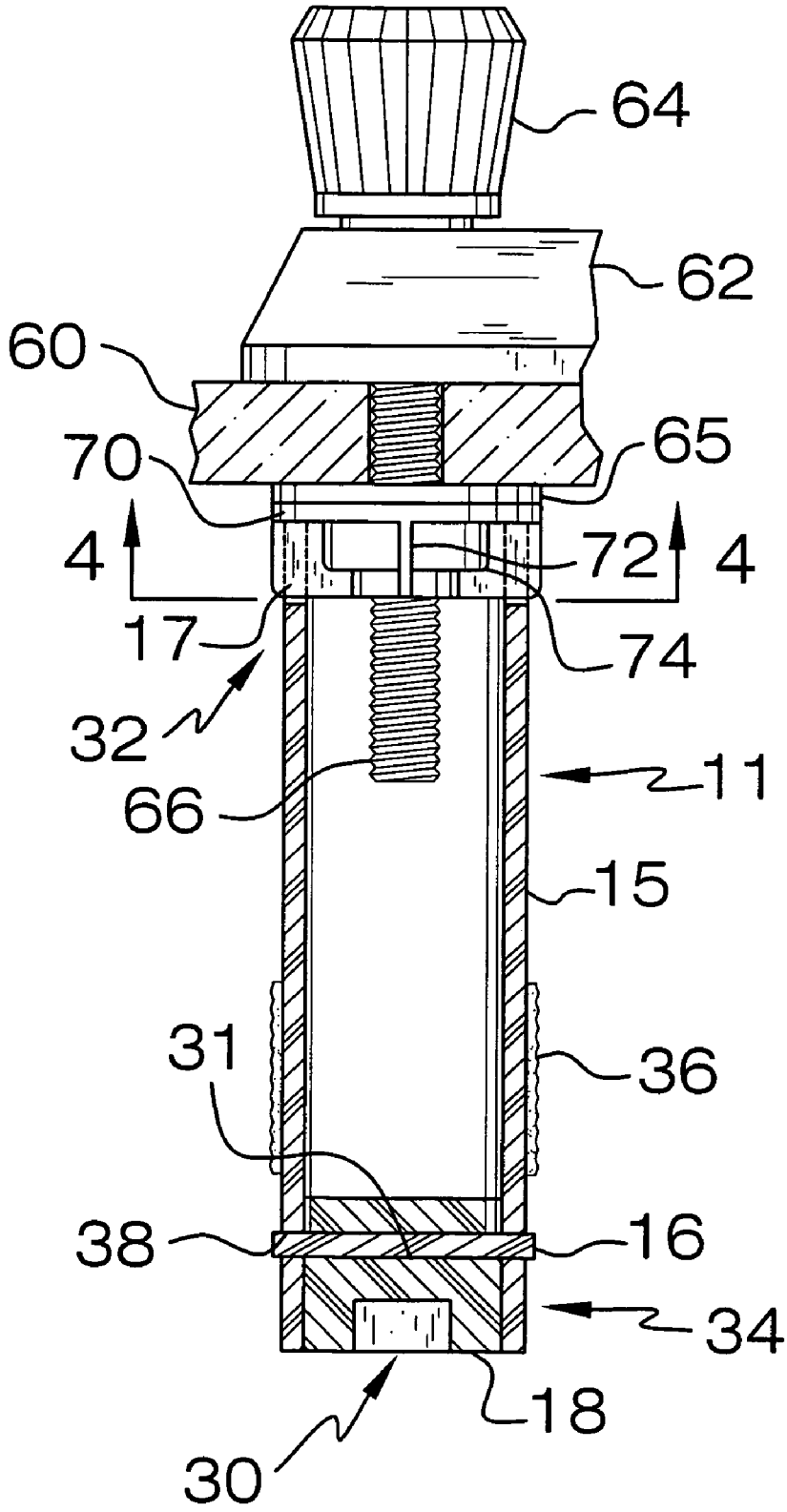
FIG. 1 is a cross sectional side view of one faucet nut wrench in use.

Referring to FIG. 1, the tubular faucet nut wrench kit 10 partially comprises a first tubular faucet nut wrench 11. The first wrench 11 is preferably 14 to 16 inches in total length. The first wrench 11 has an engagement end 32, a drive end 34, and a shaft 15 therebetween. The internal diameter of the first wrench 11 is about 1⅜ inches. Four diametrically opposed axial slots 17 are disposed in the engagement end 32 of the first wrench 11. The slots 17 are for engaging the wings 72 of a faucet nut 70. The grip surface 36 is disposed on the outer surface of the wrench 11. The grip surface 36 affords hand tightening and loosening of faucet nuts 70. The grip surface 36 is disposed proximal to the end of the drive end 34 of the wrench 11. The grip surface 36 is preferably about 1 inch away from the end of the drive end 34. The drive socket 18 is removably fitted within the drive end 34 of the first wrench 11. The outside diameter of the drive socket 18 is slightly less than the inside diameter of the drive end 34 of the wrench 11. The female square drive 30 is disposed in the center of the drive socket 18. The drive socket 18 is further comprised of a socket bore 31. The drive end 34 of the first wrench 11 is further comprised of the pin orifice 38. The lock pin 16 is removably inserted through the pin orifice 38 and socket bore 31 to selectively retain the drive socket 18 within the first wrench 11. The female square drive 30 provides for rotating the first wrench 11 with a ratchet or other square drive tool. The faucet nut 70 is tightened against the washer 65. The nut 70 is threadably engaged with the threaded nipple 66 of the faucet 62. The faucet nut 70 firmly secures the faucet 62 against the counter 60. The typical handle 64 operates the faucet 62.

Figure 2:
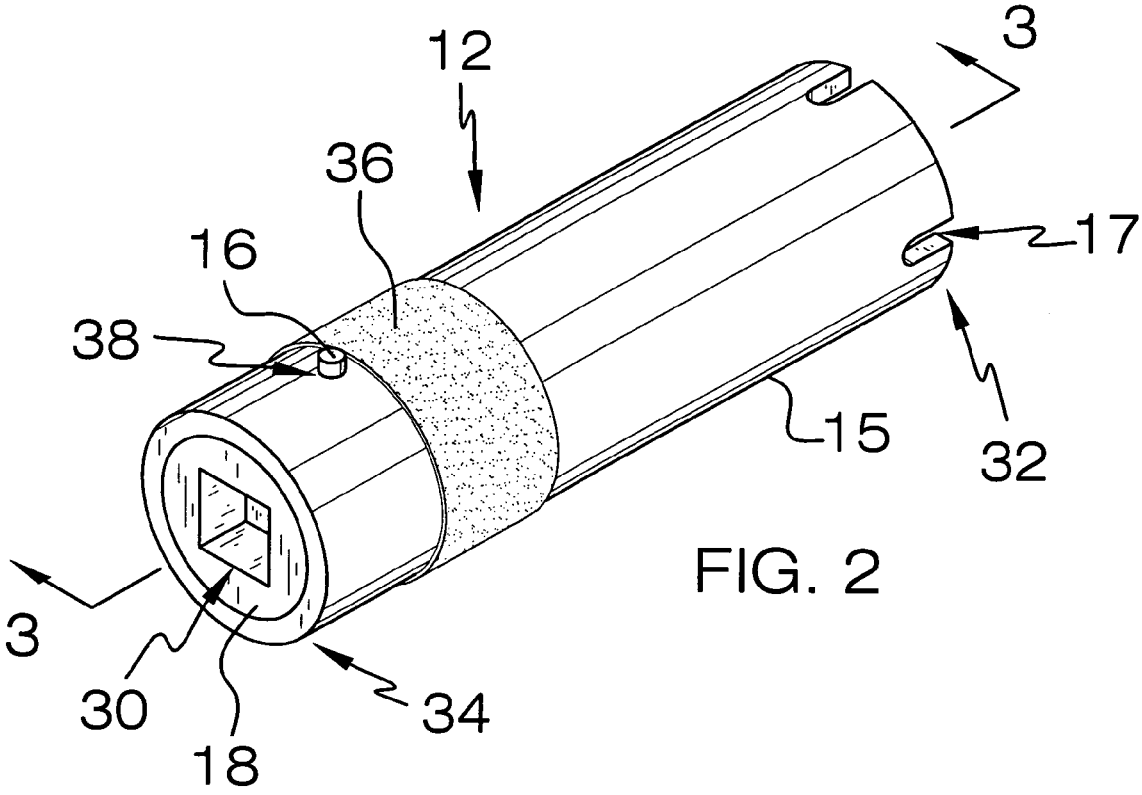
FIG. 2 is a perspective view of a nut wrench of the kit, the drive socket installed.

Referring to FIG. 2, the second tubular wrench 12 is about 4 inches in total length. The features of the second wrench 12 are identical with those of the first wrench 11 with the one exception of total length. The internal diameter of the second wrench 12 is about 1⅜ inches. Four diametrically opposed axial slots 17 are disposed in the engagement end 32 of the second wrench 12. The slots 17 are for engaging the wings 72 of a faucet nut 70. The drive socket 18 is removably fitted within the drive end 34 of the second wrench 12. The outside diameter of the drive socket 18 is slightly less than the inside diameter of the drive end 34 of the wrench 12. The female square drive 30 is disposed in the center of the drive socket 18. The drive socket 18 is further comprised of a socket bore 31. The drive end 34 of the second wrench 12 is further comprised of the pin orifice 38. The lock pin 16 is removably inserted through the pin orifice 38 and socket bore 31 as needed to retain the drive socket 18 within the second wrench 12. The female square drive 30 provides for rotating the second wrench 12 with a ratchet or other square drive tool. The grip surface 36 provides for better frictional hand grip of the wrench 12. The grip surface 36 is preferably about 1 inch from the end of the drive end of the second wrench 12.

Figure 3:
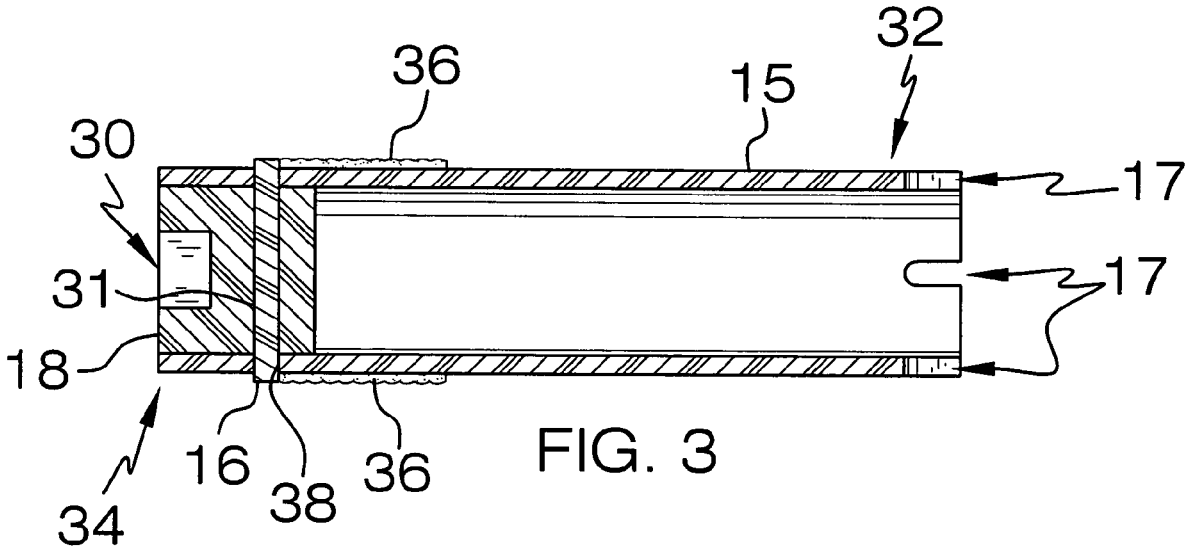
FIG. 3 is a cross sectional view of FIG. 2, taken along the line 3—3.

Referring to FIG. 3, the axial slots 17 are 90 degrees apart around the circumference of the engagement end 32 of the wrench 12. The drive socket 18 is selectively held within the drive end 34 of wrench 12 by insertion of the lock pin 16 through the pin orifice 38 and the socket bore 31. Removal of the pin 16 allows removal of the drive socket 18 from the second wrench 12.

Figure 4:
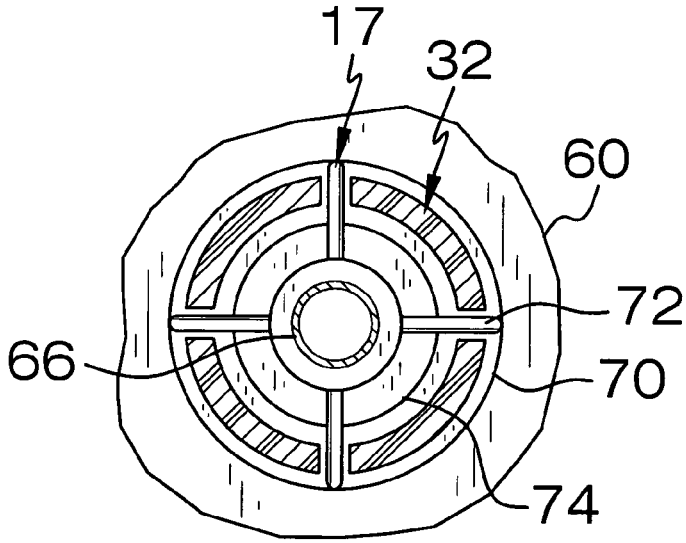
FIG. 4 is a cross sectional view of FIG. 1, taken along the line 4—4.

Referring to FIG. 4, the faucet nut 70 is threaded upon the threaded nipple 66 to hold the faucet 62 to the counter 60. The slots 17 are engaged with the wings 72 of the faucet nut 70. The nut shoulder 74 is clear of the expanded end 32 of any of the wrenches, 11, 12, 13, or 14. Turning the wings 72 of the faucet nut 70 clockwise tightens the nut 70. Counterclockwise turning of the wings 72 loosens the nut 70.

Figure 5:
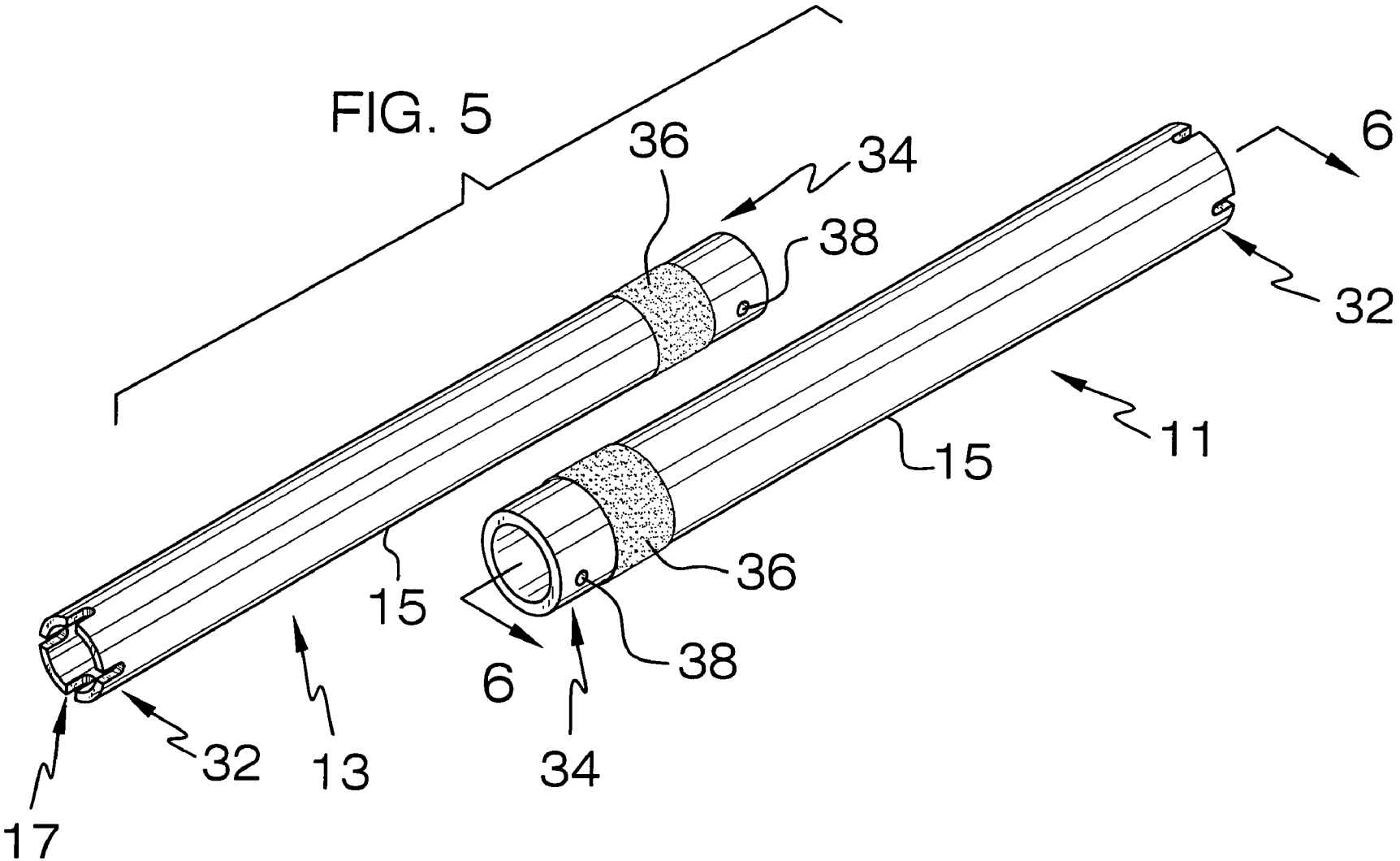
FIG. 5 is a perspective view of both of the longer nut wrenches of the kit.

Referring to FIG. 5, the third wrench 13 is identical to the first wrench 11 with the exception of the internal and external diameters of the tubular wrenches 11 and 13. The third tubular faucet nut wrench 13 has a length of 14 to 16 inches. The length is comprised of an engagement end, a drive end, and a shaft therebetween. The internal diameter of the wrench 13 is about 1 inch. The external diameter of the wrench is less than 1⅜ inches. The third wrench 13, like the first wrench 11 and second wrench 12, is further comprised of an exterior grip surface 36 proximal to the end of the drive end 34 of the third wrench 13. The wrench 13 is further comprised of at least two diametrically opposed axial slots 17 in the engagement end 32. Smaller faucet nuts 70 are accessible to wrench 13. Many smaller nuts 70 comprise only two wings 72. While the third wrench 13 usually needs only two slots 17, four slots 17 are preferred. With four slots 17, the wrench 13 can be more easily engaged with a faucet nut 70. Wrench 13 is capable of attachment to wrench 11. The attachment of wrench 13 to wrench 11 or to wrench 12 provides additional length as needed for engaging faucet nuts 70. When connected together, the drive end 34 of either wrench 11 or wrench 12 may be used to engage a faucet nut 70, depending upon the nut 70 size. Likewise, with wrench 13 connected to wrench 12, the drive end 34 or either wrench 12 or 13 may be used to engage a faucet nut 70, depending upon the nut 70 size. The slots 17 of the wrench 11, 12, 13, or 14 can also be used for the insertion of a drive tool such as a screwdriver. For example, with wrenches 11 and 13 connected, if the engagement end 32 of wrench 13 is used to engage a nut 70, the slots 17 in wrench 11 can removably receive a screwdriver shaft or the like in order for the wrenches to be turned. Or, the slots 17 in wrench 13 can be used to drive wrench 11.

Figure 6:
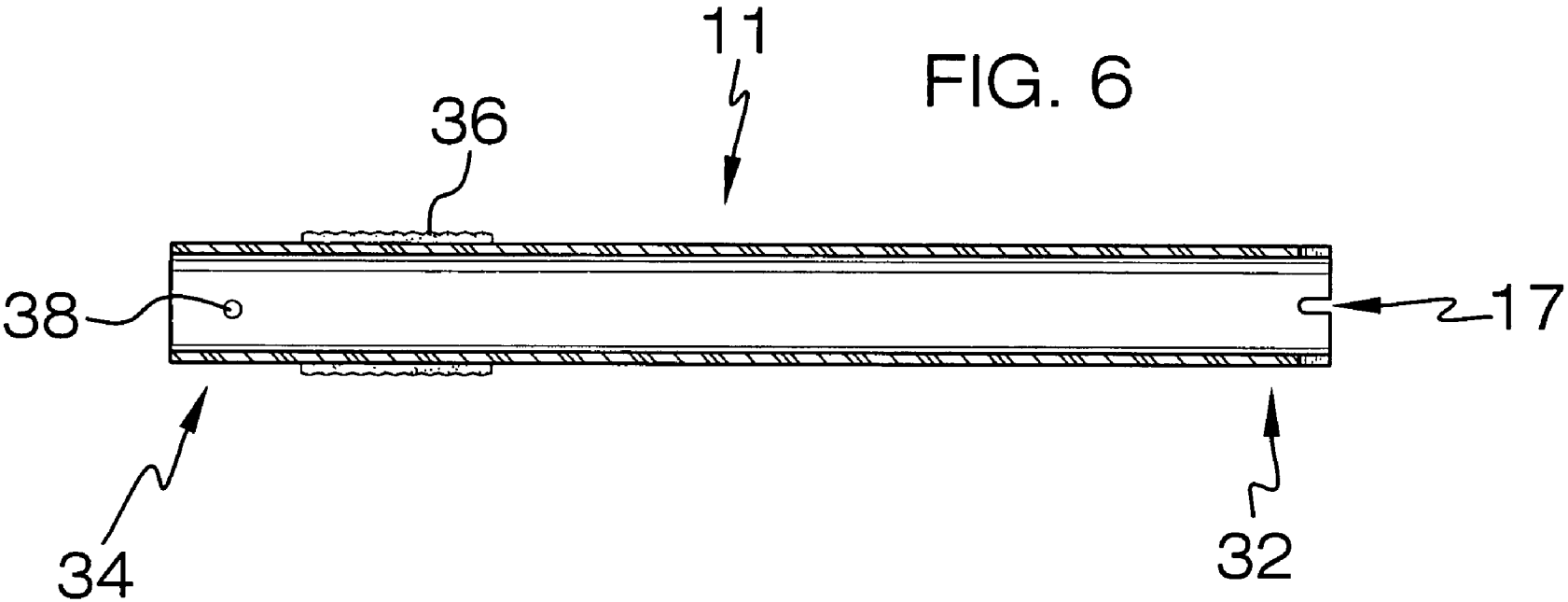
FIG. 6 is a cross sectional view of FIG. 5, taken along the line 5—5.

Referring to FIG. 6, wrench 11 is, with the exception of inside and outside diameters, identical to wrench 13. The grip surface 36 of wrench 11 is disposed medially from the end of the drive end 34 of wrench 11.

Figure 7:
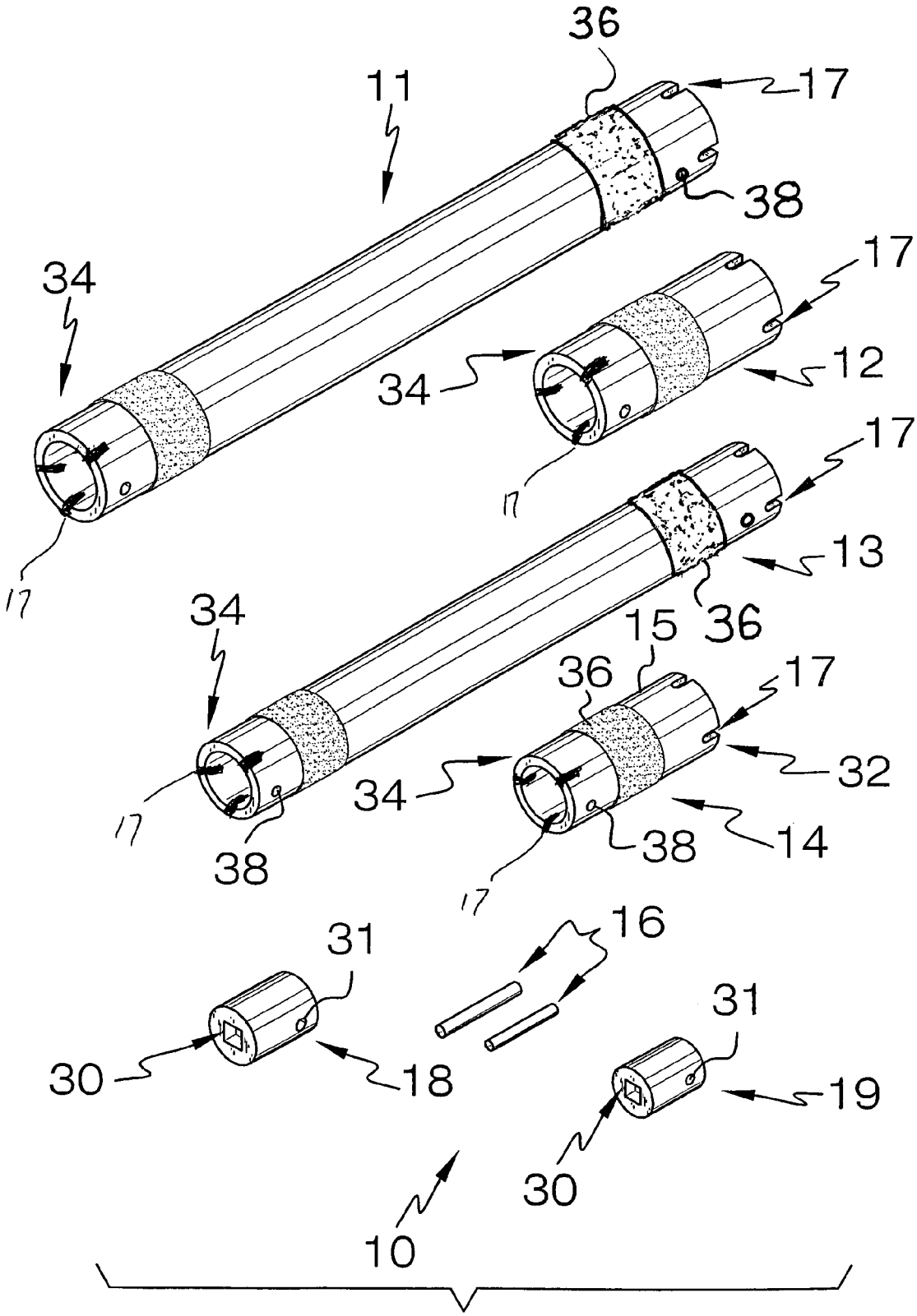
FIG. 7 is a perspective view of the components of the kit.

Referring to FIG. 7, the components an embodiment of the kit 10 include wrench 11, wrench 12, wrench 13, and wrench 14. The components of the kit 10 also include the drive socket 18 and drive socket 19 and the lock pins 16. Lock pins 16 are provided in more than one length in order to better fit the different diameters of wrenches 11 and 12 compared to wrenches 13 and 14. Drive socket 18 is slightly smaller in diameter than the 1⅜ inch internal diameter of wrenches 11 and 12. Drive socket 19 is slightly smaller in diameter than the 1 inch internal diameter of wrenches 13 and 14. Wrench 14 is almost identical to wrench 12 with the exception of internal and external diameter. Wrench 14, with the exception of length, is almost identical to wrench 13. Wrench 14 engages the same faucet nut 70 size as does wrench 13. Wrenches 13 and 14 offer insertion capabilities into wrenches 11 and 12. The complete kit 10 thereby provides the plumber with the necessary tools to engage different sizes of faucet nuts 70. The kit 10 further provides the plumber with a choice of reaches that are otherwise not possible, thereby offering virtual universal access to faucet nuts 70.

With respect to the above description then, it is to be realized that the optimum dimensional relationships for the parts of the faucet nut wrench kit, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the faucet nut wrench kit.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the faucet nut wrench kit may be used.

Therefore, the foregoing is considered as illustrative only of the principles of the faucet nut wrench kit. Further, since numerous modifications and changes will readily occur to those skilled in the art, it is not desired to limit the faucet nut wrench kit to the exact construction and operation shown and described, and accordingly, all suitable modifications and equivalents may be resorted to, falling within the scope of the faucet nut wrench kit.

What is claimed is:

1. A faucet nut wrench kit, comprising, in combination:

a first tubular faucet nut wrench, the first wrench having a length of 14 to 16 inches, the length comprised of an engagement end, a drive end, and a shaft therebetween, the first wrench having an internal diameter of about 1⅜ inches;

four diametrically opposed axial slots in the engagement end of the first wrench;

a drive socket of less than 1⅜ inches in diameter, the drive socket removably fitted within the drive end of the first wrench;

a female square drive in the drive socket;

a second tubular faucet nut wrench, the second wrench having a length of about 4 inches, the length comprised of an engagement end, a drive end, and a shaft therebetween, the third wrench having an internal diameter of about 1⅜ inches;

four diametrically opposed axial slots in the engagement end of the second wrench;

a drive socket of less than 1⅜ inches in diameter, the drive socket removably fitted within the drive end of the second wrench;

a female square drive in the drive socket;

a third tubular faucet nut wrench, the third wrench having a length of 14 to 16 inches, the length comprised of an engagement end, a drive end, and a shaft therebetween, the third wrench having an internal diameter of about 1 inch, the third wrench having an external diameter less than 1⅜ inches;

at least two diametrically opposed axial slots in the engagement end of the third wrench;

a drive socket of less than 1 inch in diameter, the drive socket removably fitted within the drive end of the third wrench;

a female square drive in the drive socket;

means for selectively and removably affixing the third wrench within the first wrench and within the second wrench, comprising:

a pin orifice in the drive end of the third wrench;

a pin orifice in the drive end of the first wrench;

a pin orifice in the drive end of the second wrench;

a removable lock pin for selective insertion within the pin orifices of the first wrench and the third wrench, and for selective insertion within the second wrench and the third wrench;

a fourth tubular faucet nut wrench, the fourth wrench having a length of about 4 inches, the length comprised of an engagement end, a drive end, and a shaft therebetween, the fourth wrench having an internal diameter about 1 inch, the fourth wrench having an external diameter less than 1⅜ inches;

at least two diametrically opposed axial slots in the engagement end of the fourth wrench;

a drive socket of less than 1 inch in diameter, the drive socket removably fitted within the drive end of the fourth wrench;

a female square drive in the drive socket;

means for selectively and removably affixing the fourth wrench within the first wrench and within the second wrench, comprising:

a pin orifice in the drive end of the fourth wrench;

a removable lock pin for selective insertion within the pin orifices of the first wrench and the fourth wrench, and for selective insertion within the second wrench and the fourth wrench.

2. The kit in claim 1 wherein the means for removably fitting each appropriate drive socket within the drive end of the each wrench comprises:

a socket bore in the drive socket;

a removable pin fitted within the pin orifice of each wrench and each drive socket.

3. The kit in claim 1 wherein an added means for turning each of the first wrench, the second wrench, the third wrench, and the fourth wrench is a grip surface on an exterior of the drive end of each wrench, the grip surface about 1 inch from an end of the drive end of each wrench.

4. The kit in claim 2 wherein an added means for turning each of the first wrench, the second wrench, the third wrench, and the fourth wrench is a grip surface on an exterior of the drive end of each wrench, the grip surface about 1 inch from an end of the drive end of each wrench.

* * * * *